United States Patent [19]

Rokicki

[11] Patent Number: 4,691,474

[45] Date of Patent: Sep. 8, 1987

[54] SLIDING DOOR ASSEMBLY WITH MULLION LOCK

[76] Inventor: Stanley Rokicki, 112 Lake Promenade, Toronto, Ontario, Canada, M8W 1A4

[21] Appl. No.: 870,953

[22] Filed: Jun. 5, 1986

[51] Int. Cl.[4] ..... E05D 15/10
[52] U.S. Cl. ..... 49/220; 49/449
[58] Field of Search ..... 49/219, 220, 449, 281

[56] References Cited

U.S. PATENT DOCUMENTS 3,383,798 5/1968 Day ..... 49/220 X
3,660,938 5/1972 Ross, Jr. et al. ..... 49/220
4,317,312 3/1982 Heidemann .
4,384,429 5/1983 Rokicki et al. .

FOREIGN PATENT DOCUMENTS 2369405 5/1978 France .

*Primary Examiner*—Kenneth Downey
*Attorney, Agent, or Firm*—Donald E. Hewson

[57] ABSTRACT

A sliding door panel is provided which moves bodily into and out of a recess so as to be closed or open, and when out of the recess it may be rolled sideways clear of the recess for ingress or egress therethrough. The moveable door panel is provided with a pair of crank shafts which carry crank arms, and one mounted so that rotation of a door handle causes rotation of the crank shafts and arms. The crank arms are each fixed at one end relative to the door, and at the other end relative to a track so as to cause the bodily movement of the door. The crank arms are also co-operatively associated with latch bars which enter latch slots at both the mullion and jamb sides of the door, so as to assure positive, intruder-proof latching of the door panel when closed.

8 Claims, 5 Drawing Figures

SLIDING DOOR ASSEMBLY WITH MULLION LOCK

FIELD OF THE INVENTION

This invention relates to sliding door assemblies. In particular, the invention relates to such sliding door assemblies as may be used for patio doors for egress from a residence to a patio or balcony.

BACKGROUND OF THE INVENTION

In most of the commonly known sliding door assemblies, the door simply slides on the slide track. The door is constrained against all other modes of movement apart from sliding along the line of the slide track. In such an arrangement as that it is difficult, as sliding door designers know, to provide an effective weatherseal around the closed door.

For high quality patio doors, therefore, an alternative to this "straight slide" arrangement has been developed, and the alternative has come to be known as the INLINE (trade mark) arrangement.

In the INLINE arrangement, the fixed door frame is provided with a recess. When the moving door panel is being moved to the closed position, the door enters this recess in a direction which is substantially perpendicular to the line of the slide track. The door has to move bodily forwardly relative to the slide track in order to enter the recess.

In the INLINE arrangement, the door does not rest directly on the slide track; instead, a pair of trolleys rest directly on the slide track and a pair of crank arms link the trolleys to the door. The arrangement is such that when the crank arms pivot, the door undergoes the required lateral movement, and the door enters the recess.

PRIOR ART

U.S. Pat. No. 4,384,429 (ROKICKI et al, May 24, 1983) is the basic patent showing a sliding door of the INLINE kind. It may be noted, however, that the door handle in the ROKICKI et al structure is not operatively connected to the crank arms.

French Pat. No. 2,369,405 (WEIKERT, May 26, 1978) shows a sliding door that undergoes a lateral movement into the recess, which is a characteristic of the INLINE arrangement. In this patent, the act of turning the door handle operates a slide bar which turns some pivot arms to move the door sideways.

U.S.A. Pat. No. 4,317,312 (HEIDEMANN, Mar. 2, 1982) also shows a door handle being used to control the movement of crank arms on a door.

To the designer of sliding doors it is therefore known to control the bodily movement of the door in and out of a recess, not by manipulation of the door itself, as was shown in ROKICKI, but by manipulation of a handle.

GENERAL DESCRIPTION OF THE INVENTION

However, none of the above patents makes provision for locking the doors by means of a latch bar that enters a latch slot formed in the door frame.

In the present invention, the door handle operates both the latch bar and also the crank arms. The benefit is that only a single operation is needed to open the door. This is an advantage as compared with the separate sequential operations of: (1) moving the door out of the recess and then (2) sliding the door along the track.

The invention provides that, when the door is being opened, the latch bar is unlatched before the door starts to move bodily out of the recess. Similarly the invention provides that, when the door is being closed, the door is entered into the recess before the latch bar enters the latch slot. It is recognized in the invention that this sequence of movements is important in ensuring smoothness in the opening and closing operations of the door handle.

The sequence of movements as described might be achieved by complex cams and linkages, but the invention provides an extremely simple manner of ensuring that the movements take place in the desired sequence.

For this reason, it is preferred, in the invention, that the crank arms lie at right angles to the line of the slide track, when the door is closed. When this is so, the crank arms then have to travel through a considerable arc of movement before the door starts to move out of the recess: if the crank arms were to lie at some other orientation when the door is closed, the door would start to move out of the recess as soon as the crank arms started to turn.

Thus, when the crank arms lie at right angles to the slide track, a considerable movement of the crank arms takes place before the door starts to move out of the recess.

It is arranged, in the invention, that the unlatching of the latch bar is accomplished in this first part of the movement of the crank arms.

Hence, the door is first unlatched and then drawn out of the recess, by a single sweep of the door handle. If the designer were to arrange that the door started to move out of the recess before the latch bar was clear of the latch slot, then the door could jam; since there is some compliance in any sliding door assembly the door might not actually jam, but there would at least be some considerable friction in its operation.

This is not to say that the crank arms must lie at exactly 90° to achieve the desired delay—all that is necessary is to make sure that the crank arms lie on that part of their arc of travel where movement of the door is very small compared with movement of the crank arms.

Another way of referring to this manner of achieving the desired pause is to refer to the mechanical advantage of the angular movement of the crank arms with respect to the bodily sideways movement of the door. In the invention, the orientation of the crank arms, when the door is closed, is an orientation where the mechanical advantage is such that the pivoting movement of the crank arms is very large compared with the lateral movement of the door. When this condition holds, the latch bar has a chance to move clear of the latch slot before the door starts to move by any significant amount.

The invention becomes even more advantageous when the sliding door assembly is of the kind that is provided with a further latch bar and a further latch slot, located on the mullion side of the door. The designer of such a door has to see to it that the mullion latch bar also is well clear of its latch slot before the door starts to move out of the recess. It is recognized in the invention that the unlatching of the mullion latch can also be carried out during the delay before the door starts upon its outwards movement. The result is a sliding door which can be opened by a single smooth turn of the door handle, and yet the door is held securely when closed by two latches, one at the jamb side and one at the mullion side.

This facility makes the sliding door assembly much more sophisticated than has been possible hitherto, particularly as regards the manner in which the various functions of the door can each be optimised without compromising the others.

The invention will not be further described by referring to actual examples of sliding door assemblies.

BRIEF DESCRIPTION OF THE DRAWINGS

This invention will not be described in association with the accompanying drawings, in which.

DETAILED DESCRIPTION OF PREFERRED EMBODIMENTS

Figures 1, 2, 3:
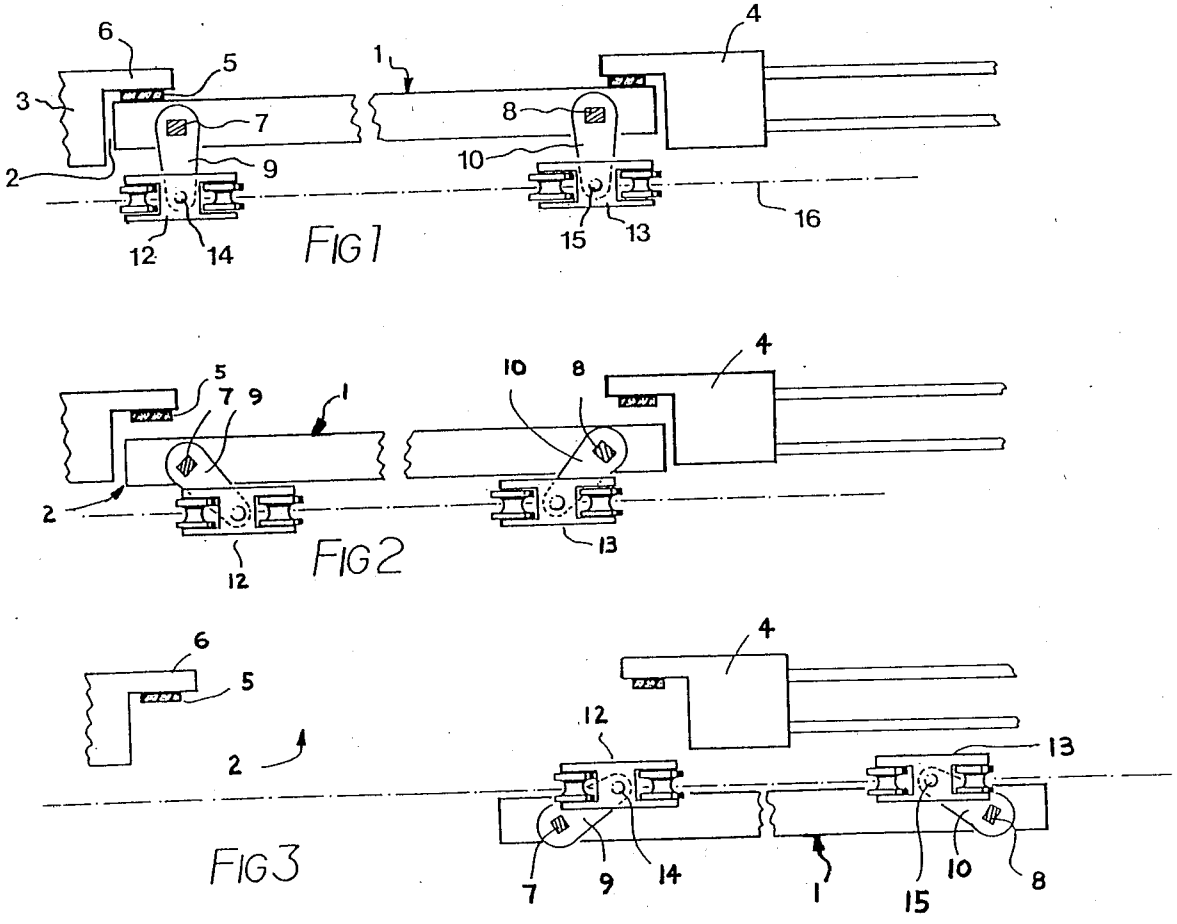
FIG. 1, FIG. 2, and FIG. 3 are views looking upwards from underneath a sliding door assembly, showing the door closed, partly-open, and fully-open respectively.

FIG. 1 shows a sliding door 1 closed into a recess 2 in the door frame between a jamb 3 and a mullion 4. The sliding door 1 compresses a weatherseal 5 against a lip 6 which lies around the recess 2.

Crankshafts 7 and 8, each of which is preferably square in cross section, are mounted in the sliding door 1 for rotation about a vertical axis. Crank arms 9 and 10 are mounted on the sliding door 1, and the crank arms 9 and 10 are arranged to follow the crank shafts 7 and 8 as regards rotary motion about the said axis. the crank arms 9 and 10 are pinned to respective trolleys 12 and 13, which are arranged to roll back and forth on a slide track 16.

It can be seen from FIGS. 2 and 3 that when the crank shafts 7 and 8 rotate, the sliding door 1 moves out of the recess 2 far enough for the sliding door 1 to clear the mullion 4. At that point the sliding door 1 may be rolled along the slide track 16 on the trolleys 12 and 13.

Figure 4:
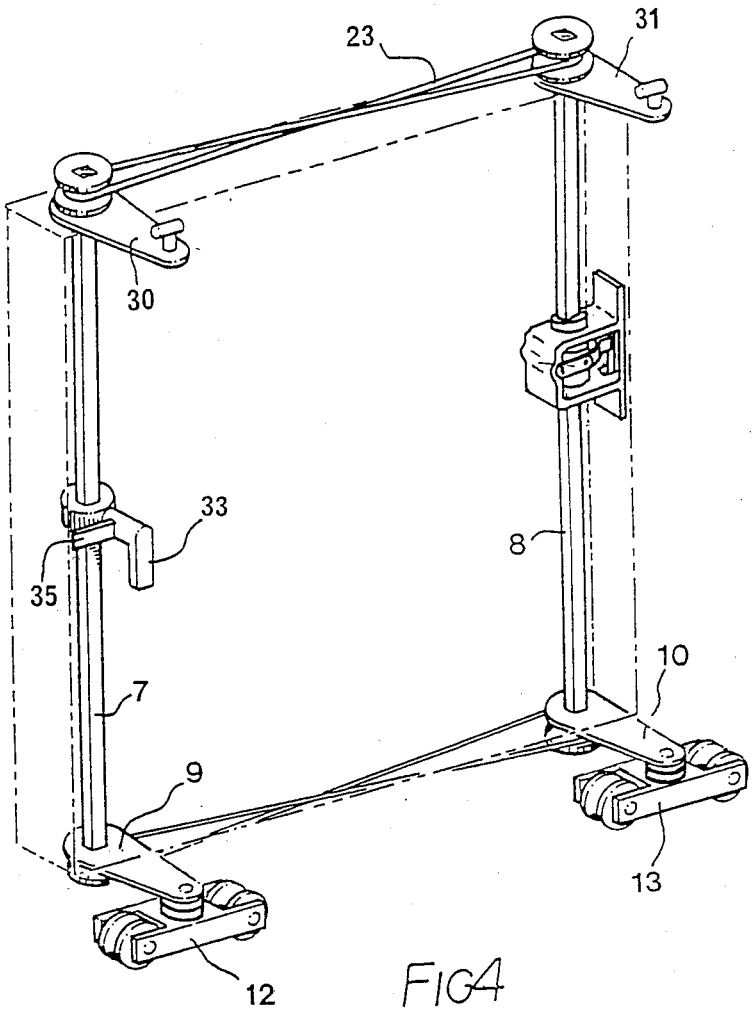
FIG. 4 is a pictorial view of a sliding door assembly.

FIG. 4 shows how the components are mounted on the sliding door 1.

The two crank shafts 7 and 8 are caused to rotate in unison (though in opposite senses) by means of drive cords 23. Corresponding crank arms 30 and 31 are provided at the top of the sliding door 1. These are provided to guide to top of the sliding door 1 in a complementary track, the weight of the sliding door 1 being taken by the crank arms 9 and 10 and trolleys 12 and 13.

A door handle 33 is mounted for operative engagement with the crank shaft 7. A jamb latch bar 35 cooperates with the handle 33 and engages a complementary latch slot in the jamb 3. The crank shaft 8 is in operative engagement with a mullion latch bar 39 which engages a respective complementary slot 41 in the mullion 4.

FIG. 4 shows the sliding door 1 in the fully closed position, with the sliding door 1 fully entered into the recess 2, and with both latch bars 35 and 39 engaged fully into their respective latch slots. At this position, the orientation of the crank arms 9 and 10 is such that the crank arms 9 and 10 lie at 90° to the line of the slide track 16.

To open the door, the door handle 33 is turned. The crank shaft 7 therefore starts to turn, and it will be noted in fact that all four of the crank arms 9, 10, 30, and 31 also start to turn, and both latch bars 35 and 39 start to turn, all in unison. The one movement that does not take place at this point is that the sliding door 1 does not move inwards to any significant degree. The reason the sliding door 1 does not move is that the crank shafts 7 and 8 lie at an orientation which precludes such movement.

Thus, both latch bars move clear of their respective latch slots before the crank shafts 7 and 8 get far enough around their arcs of travel that inwards movement of the sliding door 1 starts to become significant. After that, further movement of the door handle 33 is effective to move the sliding door 1 inwards, until finally the sliding door 1 is fully clear of the recess. The sliding door 1 may now be rolled open.

The mullion latch mechanism has to be capable of causing the latch bar 39 to turn as soon as the crank shaft 8 starts to turn. The mullion latch mechanism must then allow the crank shaft 8 to continue to turn, even though the latch bar 39 has completed its movement.

Figure 5:
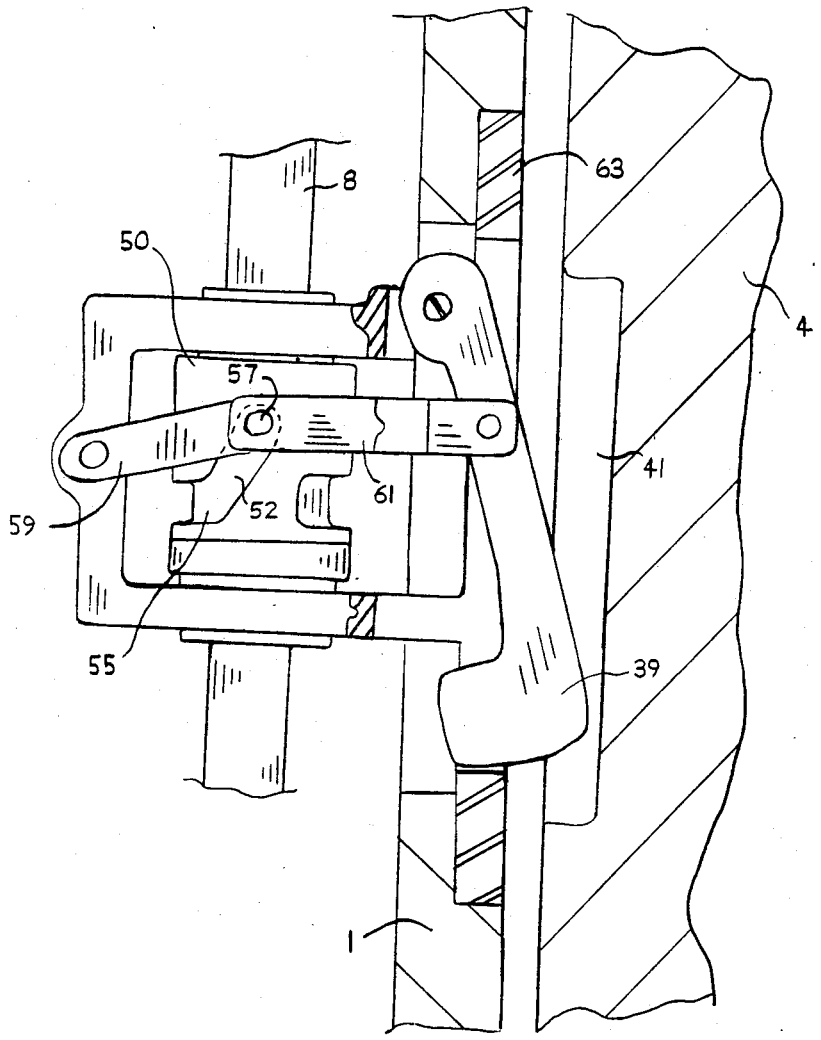
FIG. 5 is a partial cross-section of a mullion latch mechanism.

FIG. 5 shows the mullion latch mechanism in the door closed position. The square crank shaft 8 passes through a cam 50. The cam 50 has a cam track 51 which includes an upturned leg portion 53, and a circumferential portion 55. A pin 57 runs in the cam track 51. When the crank shaft 8 rotates, the pin 57 moves up and down, through an arc defined by a link 59. The pin 57 is also connected to a bracket 61. The bracket 61 in turn is pinned to the latch bar 39. The latch bar 39 is pinned to the frame 63 of the mullion latch mechanism. It will be appreciated that the bracket 61 is U-shaped and that the pin 57 and the link 59 have symmetrical counterparts on the other side of the cam 50, as does the cam track itself.

When the components of the mullion latch mechanism are in the positions as shown, the latch bar 39 is locked. It will be observed that if an attempt were to be made by a thief to force the latch bar inwards—with a crowbar for example—the bracket 61 and the link 59 would become more tightly locked: only the act of turning the crank shaft 8 will unlock the latch bar 39.

The mullion latch mechanism arranged thus has the required characteristic of the invention, that the latch bar 39 be actuated quickly, and then that the further rotation be completed without further actuation of the latch bar.

I claim:

1. In a sliding patio door assembly, comprising a door, a slide track, and a door frame which includes a recess; and where the arrangement is such that, when the door is in a first position, outside the recess, the door is free to slide along the slide track, and when the door is in a second closed position the door is entered into the recess; and where, in order to close the door, the door is moved bodily into the recess in a direction that is lateral or sideways relative to the slide track; said sliding door assembly having:

a pair of crank arms mounted on the door adjacent the sides thereof in a manner that each crank arm can pivot through an arc about a respective axis which is fixed relative to the door, said crank arms extending substantially at right angles to the plane of said door when the door is in said second, closed position;

where the initial pivoting action of the crank arms is not effective to give to the door its said lateral movement;

a door handle, which is intermedially positioned along the height of the door and adjacent one said side edge, and which is pivotable relative to the door;

a first latch bar, which is operative with the door handle;

a latch slot, which is so located in the jamb of the door frame that the first latch bar can enter the latch slot when the door is fully closed in the recess;

and a transmission connection between the door handle and the crank arms, positioned within said door in visually non-obstructing relation with the face of said patio door comprising a pair of crankshafts mounted vertically within the door adjacent the respective vertical edges thereof, and drive means located adjacent at least one horizontal edge of said door within the confines of said door interconnecting said crankshafts for rotation thereof in unison, the initial rotation of said door handle providing said initial pivoting action of said crank arms, and serving to move said first latch bar clear of said latch slot while said door remains in said second position, prior to effective rotation of said crank arms whereby the action of continuing turning the door handle is effective to cause the crank arms to rotate through an angular displacement effective to move the door from out the recess to said first position.

2. Assembly of claim 1, where the assembly includes a mullion latch bar and a mullion latch slot, positioned at the mullion side of the door;

and where the arrangement of the assembly is such that the mullion latch bar is actuated simultaneously with the said latch bar.

3. Assembly of claim 2, where the transmission connection includes a crank shaft, which is mounted for rotation with respect to the door, and which is attached unitarily to one of the crank arms.

4. Assembly of claim 3, which includes a mullion crank shaft, which is attached unitarily to the other of the crank arms;

and where the mullion latch bar is actuated by rotation of the mullion crank shaft.

5. Assembly of claim 4, where the mullion latch bar is actuated from the mullion crank shaft by means of a rotary cam.

6. The sliding door assembly as set forth in claim 1, at least one said crankshaft having cam means mounted thereon for rotation with the crankshaft, said cam means having a first upturned track portion and a second connecting circumferential track portion, said initial rotation of said handle traversing interconnecting pin means along said first track portion; said pin means traversing said second track portion during the further rotation of said crank arms.

7. The sliding patio door assembly as set forth in claim 6, including a mullion latch bar and a mullion latch slot, positioned at the mullion side of said door;

said mullion latch bar being connected with said cam means, for displacement of said mullion latch bar substantially simultaneously with displacement of said first latch bar.

8. The sliding patio door assembly as set forth in claim 7, said mullion latch bar having a pair of pivotal links in actuating relation therewith taking up a position in substantially mutually aligned relation when said mullion latch bar is in said latch slot in fully latched relation therewith, said links being positioned in overcentred relation, to preclude forcing of said latch in opening displacement.

* * * * *